US007748266B2

(12) United States Patent
Evrard et al.

(10) Patent No.: US 7,748,266 B2
(45) Date of Patent: Jul. 6, 2010

(54) DEVICE FOR ANALYZING AT LEAST ONE GAS CONTAINED IN A LIQUID, IN PARTICULAR A DRILLING FLUID

(75) Inventors: Jean-François Evrard, Montreuil-sous-Bois (FR); Jérôme Breviere, Taverny (FR); Jean Christophe Lasserre, Aniane (FR); José Sanchez Marcano, Castries (FR)

(73) Assignee: Geoservices Equipements, Le Blanc Mesnil (FR)

( * ) Notice: Subject to any disclaimer, the term of this patent is extended or adjusted under 35 U.S.C. 154(b) by 989 days.

(21) Appl. No.: 10/554,201

(22) PCT Filed: Apr. 16, 2004

(86) PCT No.: PCT/FR2004/000953

§ 371 (c)(1),
(2), (4) Date: Aug. 21, 2006

(87) PCT Pub. No.: WO2004/097175

PCT Pub. Date: Nov. 11, 2004

(65) Prior Publication Data

US 2009/0293605 A1 Dec. 3, 2009

(30) Foreign Application Priority Data

Apr. 25, 2003 (FR) ..... 03 05131

(51) Int. Cl.
*E21B 49/00* (2006.01)

(52) U.S. Cl. ..... 73/152.23; 73/152.19

(58) Field of Classification Search ..... 73/152.18, 73/152.19, 152.23, 152.25
See application file for complete search history.

(56) References Cited

U.S. PATENT DOCUMENTS

| | | | | |
|---|---|---|---|---|
| 3,673,864 | A | 7/1972 | Cubberly, Jr. | |
| 3,731,530 | A | 5/1973 | Tanguy et al. | |
| 5,351,532 | A * | 10/1994 | Hager | 73/152.55 |
| 6,276,190 | B1 | 8/2001 | Zamfes | |
| 7,219,541 | B2 * | 5/2007 | DiFoggio | 73/152.17 |
| 7,231,819 | B2 * | 6/2007 | Jones et al. | 73/152.23 |
| 7,240,546 | B2 * | 7/2007 | DiFoggio | 73/152.23 |
| 7,318,343 | B2 * | 1/2008 | Coenen | 73/152.19 |
| 7,516,654 | B2 * | 4/2009 | DiFoggio | 73/152.23 |
| 2004/0045350 | A1 * | 3/2004 | Jones et al. | 73/152.23 |
| 2005/0109098 | A1 * | 5/2005 | DiFoggio | 73/152.55 |
| 2005/0241382 | A1 * | 11/2005 | Coenen | 73/152.19 |

* cited by examiner

*Primary Examiner*—John Fitzgerald
(74) *Attorney, Agent, or Firm*—Wenderoth, Lind & Ponack, L.L.P.

(57) ABSTRACT

A device includes an analyzer (53) and a sampling apparatus (51) for taking a sample of at least one fraction of the gas that has at least one porous membrane element (55). The porous membrane element (55) has a support (63) and a first surface (57) which is in contact with liquid circulating in duct (13) and a second surface (59) which opens out into a duct (61) which is connected to the analyzer (53). The hardness of the first surface (57) is more than 1400 Vickers (kgf/mm$^2$), ranging more particularly between 1400 and 1900 Vickers (kgf/mm$^2$). The device can be used to analyze the gaseous content of oil well boring sludge.

20 Claims, 3 Drawing Sheets

DEVICE FOR ANALYZING AT LEAST ONE GAS CONTAINED IN A LIQUID, IN PARTICULAR A DRILLING FLUID

BACKGROUND OF THE INVENTION

The present invention relates to an analyzer device for analyzing at least one gas contained in a liquid, in particular a drilling liquid, flowing in a drilling pipe in an installation for extracting fluid from a subsoil. The device comprises an analyzer for analyzing the gas and a sampling apparatus for sampling at least a fraction of the gas. The sampling apparatus has at least one porous membrane member, the member comprising a support and having a first face in contact with the liquid flowing in the drilling pipe and a second face opening into a pipe connected to the analyzer.

When drilling a well for oil or some other effluent (in particular gas, steam, water), it is known to analyze the gaseous compounds contained in the drilling muds emerging from the well. Such analysis is used to reconstruct the succession of geological formations through which the borehole is being drilled and it contributes to determining the working possibilities of the fluid deposits encountered.

Such analysis is performed continuously and comprises two main stages. The first stage consists in extracting the gas conveyed by the mud (for example hydrocarbon compounds, carbon dioxide, hydrogen sulfide). The second stage consists in qualifying and quantifying the extracted gases.

For this purpose, mechanically-stirred degassers are frequently used. However, because of their size, such degassers must be installed at a distance from the well, generally close to a vibrating screen downstream from the wellhead. Muds are conveyed from the wellhead to the degasser via a flow line that might be open to the atmosphere. Thus, a fraction of the gaseous compounds present in the mud is released into the atmosphere while the mud is traveling along the line. An analysis of the gas present in the mechanically-stirred degasser is therefore not representative of the gaseous content of the mud in the well.

To solve that problem, devices of the above-specified type have been implanted directly in the drilling pipe, upstream from the wellhead, as described in U.S. Pat. No. 5,469,917. Such devices include a capillary tubular membrane supported capillary membrane (SCMS). However, the muds flowing around the membrane are laden with pieces of rock.

In order to avoid degrading the tubular membrane under the effect of impacts against these pieces of rock, the membrane is wound on a threaded rod. The thread of the support then protects the membrane against pieces of rock of a size greater than the distance between two consecutive threads of the threaded rod.

Those devices do not give entire satisfaction. To wind the membrane around the threaded rod, and thus provide it with protection, certain stresses need to be applied to the membrane. Thus, a membrane of tubular shape must be used in order to be capable of winding between the threads of the threaded rod. Furthermore, the membrane must be relatively flexible. Consequently, only a membrane based on organic materials can be used in such a device. Unfortunately, organic membranes present abilities at withstanding high temperatures and chemical compatibilities that are not always satisfactory in certain applications.

SUMMARY OF THE INVENTION

A main object of the invention is thus to provide a device for analyzing gas contained in a liquid that contains debris of varying size, in particular a drilling fluid, the device being installed directly in a pipe of an installation for extracting fluids from the subsoil, without putting large stresses on the membrane, in particular stresses concerning the nature and the shape of the membrane.

To this end, the invention provides a device of the above-specified type, characterized in that the first face presents Vickers hardness greater than 1400 kilograms-force per square millimeter (kgf/mm$^2$), in particular Vickers hardness lying in the range 1400 kgf/mm$^2$ to 1900 kgf/mm$^2$.

The device of the invention may comprise one or more of the following characteristics taken in isolation or in any technically feasible combination:

- the porous membrane member includes a coating covering the support over the first face;
- the coating is based on silicon carbide;
- the first face is also water- and oil-repellent;
- the wetting angle of water on the first face is greater than 120°;
- the first face includes fluorine-containing polymers incorporated by grafting;
- the first face of the membrane member that is in contact with the liquid is substantially plane;
- the device further comprises a regulator for regulating the pressure in the pipe in register with the second face of the membrane member; and
- it includes a plurality of membrane members, and the second faces of the members open out in succession to the pipe connected to the analyzer.

The invention also provides an installation for extracting fluids from the subsoil, the installation being of the type comprising a drilling pipe connecting at least one point of the subsoil to the surface, and a delivery pipe connected to the drilling pipe at the surface. The installation is characterized in that it further comprises at least one device according to the above-described characteristics, and in that the sampling apparatus of the device is mounted on a tubular element constituted by the drilling pipe or by the delivery pipe.

The installation of the invention may comprise one or more of the following characteristics taken in isolation or in any technically feasible combination:

- the first face of the membrane member in contact with the liquid is disposed substantially parallel to the long axis of the tubular element;
- the first face in contact with the liquid is disposed in a wall of the tubular element;
- the first face is disposed set back in a wall of the tubular element;
- the tubular element includes a branch connection and the sampling apparatus is placed in the branch connection; and
- the sampling apparatus of the device is placed in the drilling pipe upstream from the delivery pipe; and
- the installation further includes a filter downstream from the delivery pipe and it includes two devices as defined above, the respective sampling apparatus of the two devices being placed respectively upstream and downstream of the filter.

BRIEF DESCRIPTION OF THE DRAWINGS

Embodiments of the invention are described below with reference to the accompanying drawings, in which.

DETAILED DESCRIPTION OF THE PREFERRED EMBODIMENT

Figure 1:
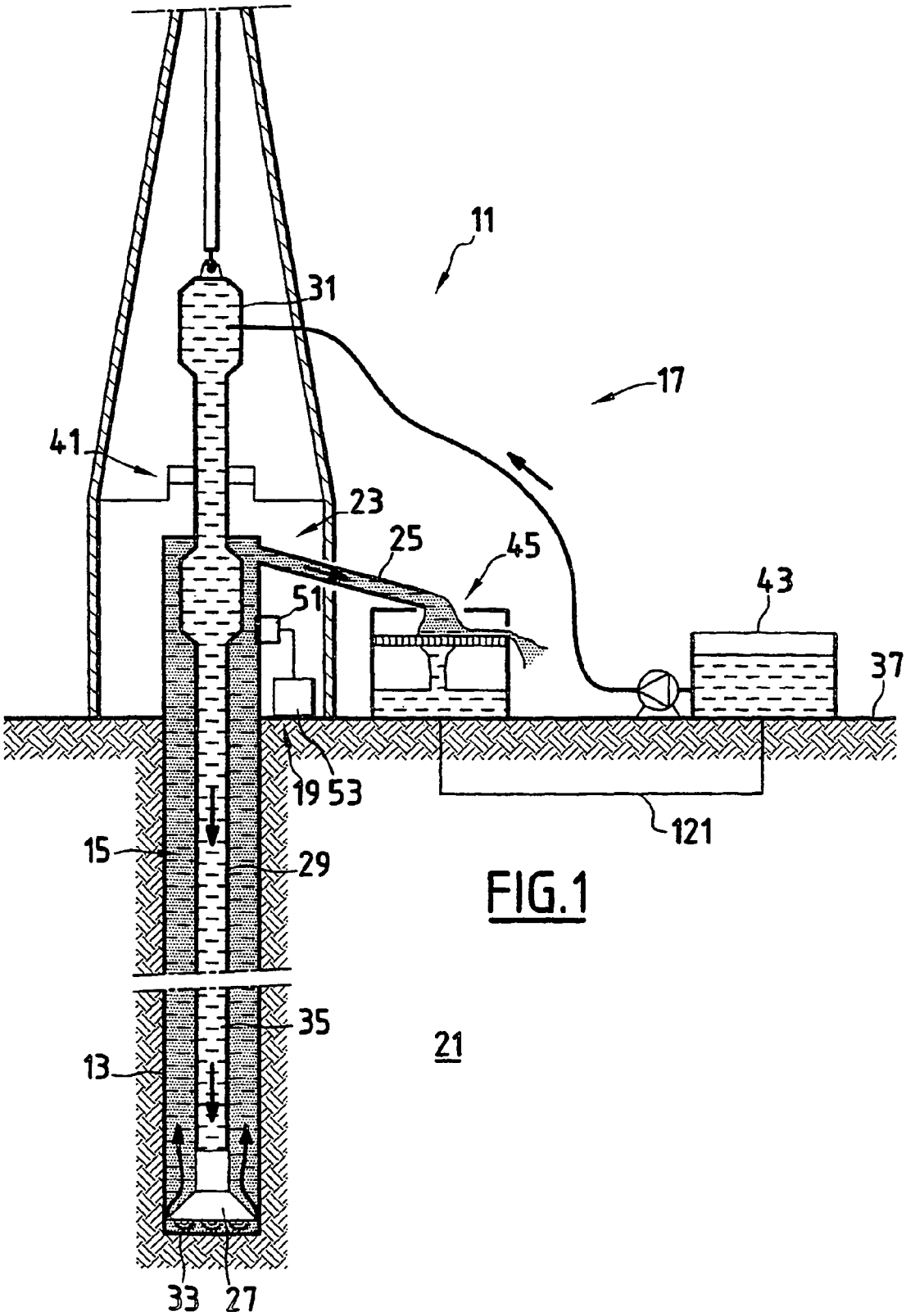
FIG. 1 is a diagrammatic vertical section view of a drilling installation provided with an analyzer device of the invention.

A device of the invention is used for example in an installation 11 for drilling an oil production well. As shown in FIG. 1, the installation 11 comprises a drilling pipe 13 in a cavity pierced by a rotary drilling tool 15, a surface installation 17, and an analyzer device 19 of the invention mounted on the drilling pipe 13.

The drilling pipe 13 is placed in the cavity drilled in the subsoil 21 by the rotary drilling tool 15. At the surface, the pipe 13 has a wellhead 23 provided with a delivery pipe 25.

The drilling tool 15 comprises a drilling head 27, a drill string 29, and a liquid injector head 31.

The drilling head 27 has means 33 for drilling rock in the subsoil 21. It is mounted at the bottom end of the drill string 29 and it is positioned in the bottom of the drilling pipe 13.

The drill string 29 comprises a set of hollow drilling tubes. These tubes define an inside space 35 enabling a liquid to be taken from the surface 37 to the drilling head 27. For this purpose, the liquid injector head 31 is screwed onto the top portion of the drill string 29.

The surface installation 17 includes means 41 for supporting and rotating the drilling tool 15, means 43 for injecting drilling liquid, and a vibrating screen 45.

The injector means 43 are hydraulically connected to the injector head 31 to inject and drive a liquid along the inside space 35 of the drill string 29.

The vibrating screen 45 collects the liquid laden with drilling residue that leaves the delivery pipe 25 and separates the liquid from the drilling residue.

The analyzer device 19 has a sampling head 51 for taking at least a fraction of the or each gas, and analyzer means 53 for analyzing the or each gas.

Figure 2:
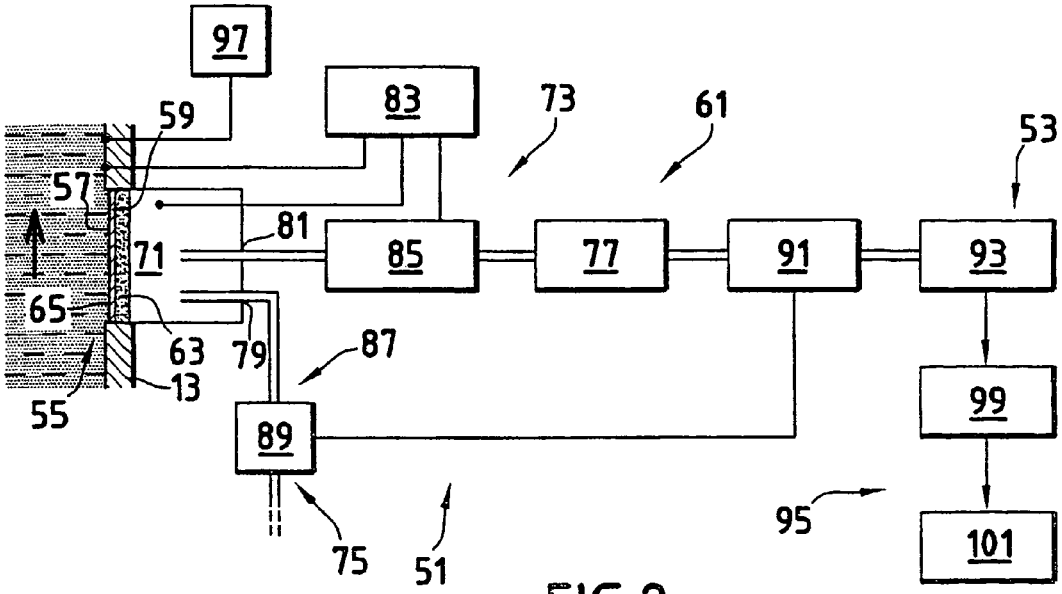
FIG. 2 is a diagram showing the main elements of the analyzer device of the invention.

As shown in FIG. 2, the sampling head 51 comprises a porous membrane member 55 having a plane first face 57 in contact with the liquid flowing in the pipe 13 and a second face 59 looking into a pipe 61 connected to the analyzer means 53.

The porous membrane member 55 comprises a membrane support 63 and a coating 65 covering the support 63 beside the liquid on the first face 57.

This first face 57 is disposed in the pipe 13 parallel to the long axis of the pipe 13, i.e. parallel to the flow of liquid. This first face 57 is preferably disposed along a wall of the pipe 13 or else is set back a little from said wall. Thus, tools can be inserted or extracted into or from the drilling pipe 13 while minimizing any risk of damaging the membrane member 55 by mechanical contact or impact. Furthermore, having the liquid flow parallel to the first face 57 puts a limit on the abrasive forces that are applied to the coating 65.

The membrane support 63 is made on the basis of a porous material, e.g. a ceramic. Preferably, the membrane support 63 is in the form of a disk. In the example shown in the drawings, the diameter of the support is substantially equal to 50 millimeters (mm) and its thickness is less than 10 mm.

Examples of materials suitable for use in making the membrane support 63 include sintered stainless steel, metal fibers, or alumina fibers.

The size of the pores in the membrane support 63 lies in the range 0.01 micrometers (μm) to 5 μm, depending on the intended application. Pore diameter is preferably selected to lie in the range 0.02 μm to 3 μm.

The coating 65 which constitutes the first face 57 of the membrane member 55 comprises a thin layer based on silicon carbide deposited on the support 63. The thickness of this layer lies in the range 0.5 μm to 2 μm. This thin layer covers the surface of the support between the pores.

Thus, the membrane member 55 is permeable to all of the gas present in the mud.

Furthermore, the Vickers hardness of the first face 57 of the membrane member 55 is greater than 1400 kgf/mm$^2$. In the example described in the figures, this Vickers hardness lies in the range 1400 kgf/mm$^2$ to 1900 kgf/mm$^2$.

This thin layer thus protects the membrane member 55 against abrasion generated by pieces of rock and drilling debris.

In a variant, the coating 65 is modified by grafting fluid-containing polymer chains that are highly water- and oil-repellent. This grafting is preferably performed on the basis of a perfluoroalkylethoxysilane. This modification of the coating 65 enables the first face 57 of the membrane member 55 to be made water- and oil-repellent. Consequently, the wetting angle of water on the first face 57 of the membrane member 55 is greater than 120°, and is substantially equal to 130°.

The membrane member 55 is thus impermeable to the liquid flowing in the pipe, which contributes to limiting clogging of the pores in the support by solid residue coming from the liquid.

The pipe 61 connecting the porous membrane member 55 to the analyzer means 53 includes a gas-receiver chamber 71, a pressure controller 73 for controlling pressure in the chamber, means 75 for conveying the extracted gas from the receiver chamber 71 to the analyzer 53, and filter 77 for filtering the extracted gas.

The receiver chamber 71 covers the second face 59 of the membrane member, in register with the first face 57. It comprises a bell having an inlet orifice 79 and an outlet orifice 81 connected, respectively to the conveying means 75 and to the pressure controller 73.

The pressure controller 73 for controlling pressure in the chamber comprises elements 83 for measuring the pressure difference between the liquid in the pipe and the gas in the chamber, associated with a pressure regulator 85 mounted on the delivery pipe downstream from the chamber.

This regulator 85 is controlled in such a manner that when the device of the invention is used for analyzing the gases contained in mud, the pressure difference between the liquid flowing in the drilling pipe 13 and the gas present in the receiver chamber 71 is substantially zero. This substantially zero pressure difference prevents the liquid flowing in the drilling pipe 13 from penetrating into the membrane member 55.

Nevertheless, if the porous membrane member 55 should become clogged, it is possible to control the pressure regulator 85 so that the pressure in the chamber 71 becomes much greater than the pressure in the drilling pipe 13 for a few seconds. The difference between these two pressures can then lie in the range 1 bar to 3 bar. It is thus possible to unclog the pores in the membrane member 55.

The means 75 for conveying the extracted gas comprise means 87 for introducing a vector gas into the receiver chamber 71 via the inlet orifice 79. By way of example, the vector gas is nitrogen or air.

A mass flow regulator 89 sets the rate at which the vector gas enters into the chamber 71, and consequently the rate at which gas enters into the analyzer 53. As a result, the rate of dilution of the extracted gas is constant over time. A volume flow meter 91 is mounted in the pipe 61 downstream from the filter means 77 in order to measure the flow of gas that results from the vector gas together with the extracted gases.

The filter 77 is disposed on the pipe downstream from the pressure regulator 85. The filter 77 serves in particular to eliminate the water vapor present in the extracted gas. By way of example it is constituted by a desiccator based on silica gel filter cartridges, a molecular sieve, or a coalescing filter.

The analyzer 53 comprises instrumentation 93 for detecting and quantifying one or more extracted gases, together with a computer 95 for determining the gas concentration in the liquid flowing in the drilling pipe 13.

By way of example, the instrumentation comprises infrared detector appliances for quantifying carbon dioxide, flame ionizing detector (FID) chromatographs for detecting hydrocarbons, or indeed a thermal conductivity detector (TCD), depending on the gases to be detected. It is thus possible with the device of the invention to detect and quantify a plurality of gases simultaneously.

This instrumentation 93 is placed in the explosive zone in the vicinity of the well head 23 (FIG. 1) in order to avoid conveying the gases over a long distance, thereby improving measurement accuracy.

The analyzer further comprises a sensor 97 for measuring the temperature of the liquid flowing in the drilling pipe 13.

The computer 95 has a memory 99 containing calibration charts and a processor 101 for implementing a calculation algorithm.

The calibration charts are established as a function of temperature, of flow rate, and of the characteristics of the mud. They contain data relating to the concentration of one or more gases in the mud to the concentration of the gases extracted from the mud through the membrane member, and as measured using the instrumentation.

The calculation algorithm determines the real quantities of the gases in the mud on the basis of the measurements performed by be instrumentation 93, the temperature measured in the drilling pipe 13 by the sensor 97, and the data contained in the memory 99.

The concentration of gases in the mud is determined either individually or cumulatively.

The operation of the device of the invention while drilling a well is described below by way of example.

While drilling, the drilling tool 15 is rotated by the surface installation 41. A drilling liquid is introduced into the inside space 35 of the drill string 29 by the injector means 43. The liquid goes down to the drilling head 27 and passes into the drilling pipe 13 through the drilling head 27. This liquid cools and lubricates the drill 33. Thereafter the liquid collects the solid cuttings that result from the drilling, and it rises via the annular space defined between the drill string 29 and the walls of the drilling pipe 13. This liquid flows substantially parallel to the walls.

The liquid thus flows continuously over the first face 57 of the membrane member 55. A fraction of the gas present in the liquid is extracted through the membrane member 55 and penetrates into the extractor chamber 71. The pressure controller 73 controlling the pressure in the chamber 71 is activated so that the pressure difference between the chamber 71 and the drilling pipe 13 is substantially zero. This prevents liquid penetrating into the membrane member 55.

The extracted gases are then entrained by the vector gas from the extractor chamber 71 through the outlet orifice 81, the pressure regulator 85, and the filter 77 to the analyzer 53. The extracted gases are then analyzed by the instrumentation 63 and the computer 95 determines the real concentration of each analyzed gas in the drilling mud as a function of time.

Figure 3:
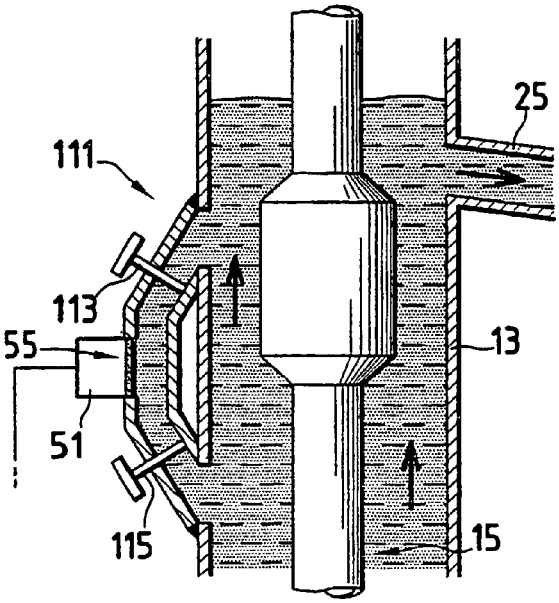
FIG. 3 is a diagram showing a detail of a variant of the installation shown in FIG. 1.

In the variant shown in FIG. 3, the sampling head 51 is installed in a branch connection 111 on the drilling pipe 13. Isolation means, such as an inlet valve 113 and an outlet valve 115, are provided at the ends of the branch connection 111 on either side of the head 51 to isolate the branch connection and make it easy to remove the sampling head 51. In this configuration, the risk of the membrane member 55 being damaged by mechanical contact or impact when tools are being inserted into the drilling pipe 13 or are being moved thereabout is minimized.

Figure 4:
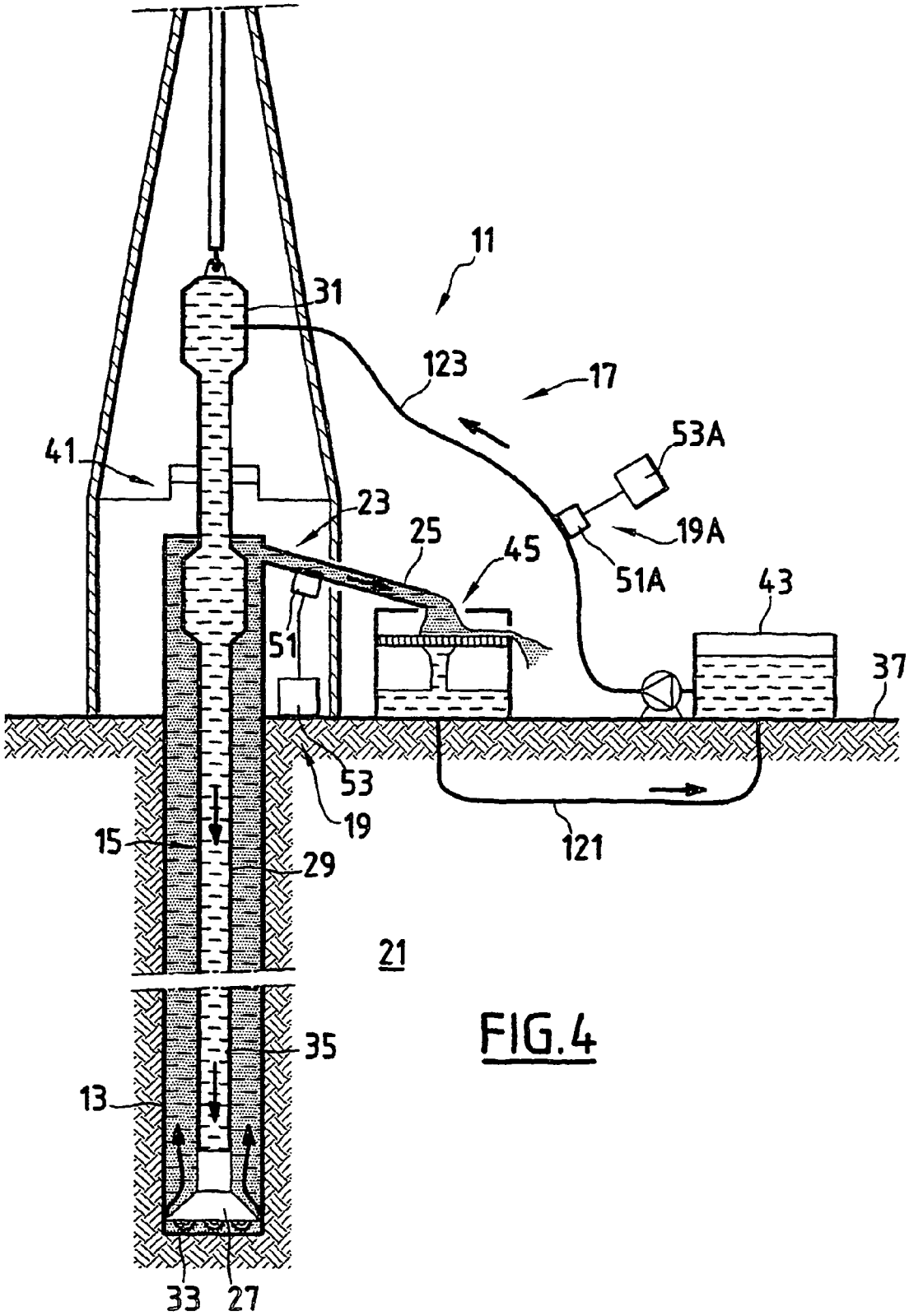
FIG. 4 is a diagrammatic vertical section view of an installation including two analyzer devices of the invention.

In the variant shown in FIG. 4, a recirculation pipe 121 is provided for conveying the liquid extracted from the vibrating screen 45 to the means 43 for injecting liquid into the inside space 35 of the drill string 29.

Unlike the installation shown in FIG. 1, two devices of the invention 19 and 19A are used. The measuring head 51 of the first device 19 is disposed on the delivery pipe 25 in the upstream portion of said pipe, i.e. at the wellhead 23. The measuring head 51A of the second device 19A is disposed on the injection pipe 123 between the injector means 43 and the injector head 31. It is thus possible to quantify the difference between the gaseous content of the liquid leaving the drilling pipe 13, and the gaseous content of the liquid reinjected after being degassed by the filtering screen 45.

Figure 5:
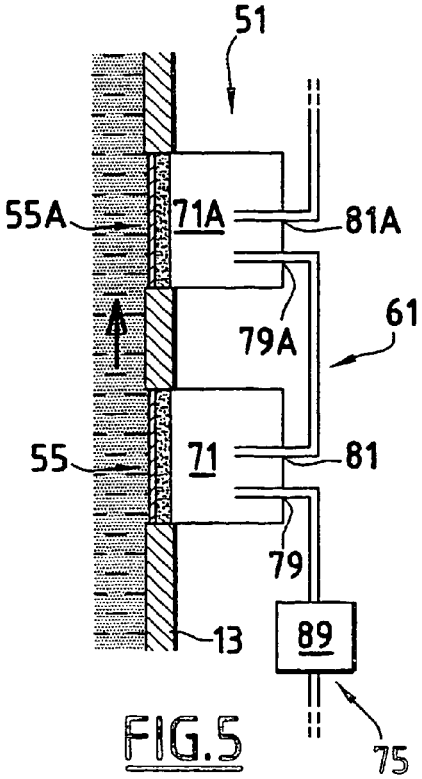
FIG. 5 is a diagrammatic vertical section view showing a detail of a variant of the device shown in FIG. 2.

In the variant shown in FIG. 5, unlike the device shown in FIG. 1, the sampling head 51 has two porous membrane members 55 and 55A. Each porous membrane member 55, 55A is associated with a respective receiver chamber 71, 71A for receiving extracted gases, and each having an inlet orifice 79, 79A and an outlet orifice 81, 81A. The inlet orifice of the first chamber is connected to the conveyor means 75. The outlet orifice 81 of the first chamber is connected to the inlet orifice 79A of the second chamber 71A by the pipe 61.

Thus, the vector gas is brought into the first chamber 71 via the inlet orifice 79 of said first chamber 71. This gas brings the gases extracted into the first chamber 71 up to the second chamber 71A via the outlet orifice 81, the pipe 61, and the inlet orifice 79A of the second chamber 71A. The second chamber 71A thus receives a mixture containing the gases extracted into the first chamber 71 and the vector gas. This mixture then receives the gases extracted into the second chamber 71A, thereby enriching it in gas coming from the drilling pipe 13 and making it easier for the analyzer 53 to detect the extracted gases.

In a variant, the support 63 of the porous membrane member has a face that presents Vickers hardness greater than 1400 $kgf/mm^2$, in particular lying in the range 1400 $kgf/mm^2$ to 1900 $kgf/mm^2$, without it being necessary to have a coating based on silicon carbide. In an example, the membrane member of this type may be made of $\alpha$ alumina.

In another variant, the membrane support is made on the basis of an organic material such as polytetrafluoro-ethylene, for example, and it has a coating of silicon carbide.

In another variant, a heater means is implanted on the drilling pipe upstream from the device of the invention relative to the flow direction of the drilling fluid in order to make it easier to extract dissolved or free gases. Under such circumstances, the device and the heater are disposed in a branch connection through which the mud flows freely or under assistance.

The invention as described above provides a device for analyzing accurately and continuously the gases contained in an abrasive liquid flowing along an installation for drilling into the subsoil.

Membrane members of a variety of kinds and shapes can be used with the device, depending on the characteristics of the drilling fluid and on the configuration of the well being drilled.

In particular, the device can be made from membranes that are simple in shape and easily available such as membranes in the form of plane disks.

The device is not selective and can be used to analyze individual or accumulated concentrations of a plurality of gases that are dissolved or free in the drilling liquid.

The device also presents the advantage of minimizing any risks of the device being damaged when objects are inserted into the drilling pipe and moved therealong.

The device also makes it possible to limit to a very great extent any clogging of the membranes and to limit the resulting loses of efficiency.

What is claimed is:

1. An analyzer device for analyzing at least one gas contained in a liquid flowing in a drilling pipe or delivery pipe in an installation for extracting fluid from a subsoil, the analyzer device comprising:

analyzer means for analyzing the at least one gas; and sampling means for sampling at least a fraction of the at least one gas and comprising at least one porous membrane member, said porous member comprising a support and possessing a first face in contact with the liquid flowing in the drilling pipe or delivery pipe and a second face that faces into a pipe connected to said analyzer means;

wherein said first face has a Vickers hardness greater than 1400 kgf/mm$^2$.

2. The analyzer device of claim 1, wherein said first face of said porous membrane member that is in contact with the liquid is substantially plane.

3. The analyzer device of claim 1, and further comprising a regulator means for regulating pressure in said pipe connected to said analyzer means.

4. The analyzer device of claim 1, wherein said sampling means comprises a plurality of porous membrane members that have second faces facing in succession said pipe connected to said analyzer means.

5. The analyzer device of claim 1, wherein said first face is in contact with a drilling liquid in the drilling pipe.

6. The analyzer device of claim 1, wherein said first face has a Vickers hardness lying in a range of 1400 kgf/mm$^2$ to 1900 kgf/mm$^2$.

7. The analyzer device of claim 1, wherein said porous membrane member includes a coating covering said support over said first face.

8. The analyzer device of claim 7, wherein said coating is based on silicon carbide.

9. The analyzer device of claim 1, wherein said first face is water and oil repellent.

10. The analyzer device of claim 9, wherein the wetting angle of water on said first face is greater than 120°.

11. The analyzer device of claim 9, wherein said first face includes fluorine-containing polymers incorporated by grafting.

12. An installation for extracting fluids from the subsoil, said installation comprising a drilling pipe connecting at least one point of the subsoil to the surface, a delivery pipe connected to said drilling pipe at the surface and at least one analyzer device according to claim 1, wherein said sampling means is mounted on a tubular element constituted by said drilling pipe or said delivery pipe.

13. The installation according to claim 12, wherein said first face in contact with the liquid is disposed in a wall of said tubular element.

14. The installation according to claim 12, wherein said sampling means is located in said drilling pipe upstream of said delivery pipe.

15. The installation according to claim 12, further comprising a filter downstream of said delivery pipe, wherein said at least one analyzer device comprises two analyzer devices, said sampling means of said two analyzer devices being located upstream and downstream of said filter, respectively.

16. The installation of claim 12, wherein said first face in contact with the liquid is disposed substantially parallel to the long axis of said tubular element.

17. The installation according to claim 16, wherein said first face is set back in a wall of said tubular element.

18. The installation according to claim 17, wherein said tubular element includes a branch connection and said sampling means is located in said branch connection.

19. An analyzer device for analyzing at least one gas contained in a liquid flowing in a drilling pipe or delivery pipe in an installation for extracting fluid from a subsoil, the analyzer device comprising:

an analyzer for analyzing the at least one gas; and a sampling apparatus for sampling at least a fraction of the at least one gas and comprising at least one porous membrane member, said porous member comprising a support and possessing a first face in contact with the liquid flowing in the drilling pipe or delivery pipe and a second face that faces into a pipe connected to said analyzer;

wherein said first face has a Vickers hardness greater than 1400 kgf/mm$^2$.

20. The analyzer device of claim 19, wherein said first face has a Vickers hardness lying in a range of 1400 kgf/mm$^2$ to 1900 kgf/mm$^2$.

* * * * *